United States Patent [19]

Chaban

[11] Patent Number: 4,759,548

[45] Date of Patent: Jul. 26, 1988

[54] REALISTIC GOLF-SIMULATING BOARD GAME

[76] Inventor: Joseph M. Chaban, 2587 Ringling Blvd., Sarasota, Fla. 33577

[21] Appl. No.: 16,000

[22] Filed: Feb. 18, 1987

[51] Int. Cl.[4] ..... A63F 3/04; A63F 7/06

[52] U.S. Cl. ..... 273/245; 273/284; 273/DIG. 26

[58] Field of Search ..... 273/242, 243, 245, 246, 273/280, 259, 277, 284

[56] References Cited

U.S. PATENT DOCUMENTS 2,682,408 6/1954 Warns et al. ..... 273/245

2,839,303 6/1958 Baker ..... 273/280 X 4,277,065 7/1981 White ..... 273/245

4,550,917 11/1985 Ferris et al. ..... 273/246

*Primary Examiner*—Richard C. Pinkham

*Assistant Examiner*—William E. Stoll

*Attorney, Agent, or Firm*—Peter N. Jansson, Ltd.

[57] ABSTRACT

A board game simulating golf. The game has an annular golf course playing surface which maps fairway surface and a contiguous array of hazards with a grid of radial distance lines and annular direction lines on it. Highly preferred embodiments provide infinite variation in golf hole characteristics by virtue of a rotational partial overlay having its own map portions combinable with varying exposed map portions of the base board. Preferred embodiments also include a top member providing a movable tee and a shot distance gauge. Two sets of random determiners simulate golf shots.

19 Claims, 3 Drawing Sheets

REALISTIC GOLF-SIMULATING BOARD GAME

FIELD OF THE INVENTION

This invention is related generally to board games which simulate outdoor sports and, more particularly, to a board game simulating golf.

BACKGROUND OF THE INVENTION

Golf is an ancient and well-known game which is played out-of-doors on a varied and extensive course covering many acres. The game of golf involves striking a golf ball using a set of golf clubs, having heads designed for various distances, along a series of varying geographical layouts known as holes. A group of holes (usually either 9 or 18) form what is known as a golf course. There are thousands of golf courses and each course and each hole on each course is unique.

Each hole has a starting area known as the tee and a finishing area known as the green. Corresponding pairs of tees and greens are separated by strips of surface having differing lengths and consisting of a long and often irregular area of short grass known as a fairway and a contiguous array of hazards. The hazards include such things as sand traps, water (ponds, lakes, streams), trees and bushes, long grass referred to as "rough," and out-of-bounds areas. The green has a cup, marked by a flag, which is the target.

The object of the game of golf is to propel the golf ball, by means of the clubs, from the tee to the cup in as few strokes as possible. In general, the player with the least number of strokes wins. Various scoring systems can be used in a match, including those known as stroke play and match play.

Golf is a game which demands undivided attention and because of this can allow the worries of the day to shrink in the mind of the golfer. The need for concentration becomes important as the golfer goes from one hole to another. He finds that each hole has a distinctly different set of hazards and requirements.

The game of golf has risen greatly in popularity in recent years. Many people are attracted to golf by the unique qualities referred to above. Yet because of the physical requirements of golf, the frequent presence of cold or wet weather unsuitable for play, ill health, or the fact that insufficient time is available to play a full round, it is too frequently impossible to play golf.

For many reasons, including the above, various efforts have been made to develop board games simulating golf. Examples of prior golf board games include those disclosed in the following U.S. Pat. Nos.:

4,277,065 (White)
4,113,260 (Sain)
2,682,408 (Warns et al.)
4,123,058 (Furyk et al.)
4,380,338 (Lacy)
4,364,569 (Duwell et al.)
3,944,229 (Feeney)
3,910,581 (Nicholson)
3,826,498 (Monek)
3,658,339 (Boileau)
3,608,901 (Royle)
2,478,949 (Snyder)
1,780,256 (Walss)
1,728,630 (Sanderson)

Many of such prior golf board games utilize boards having golf holes laid out on them, golf ball markers, dice and other random determiners, scoring mechanisms, and so forth. However, the golf board games of the prior art have a number of problems and shortcomings which detract from play and/or make them rather inaccurate simulations of real golf.

One significant drawback is that certain prior golf board games lack substantial variation in the golf holes. That is, typically 9 or 18 specific golf holes are available and no further variation is possible. The hole lengths are typically all determined as are the positions of various hazards along different portions of the length of the hole.

Another problem is that many of such golf board games are too complex in the rules and the mechanisms which they use in an effort to accurately simulate the game of golf. In many cases, various card decks, spinners and other mechanisms are used in particular combinations which may be considered unnatural to golfers. In some cases, such complexity and unnaturalness are objectionable to those familiar with well-accepted board games of other types.

Still another drawback is that many prior golf board games present very little in the way of tactical considerations of the type known to committed golfers. And, some prior games in their use of shot length and shot direction determiners do not replicate real golf particularly well.

With all these factors in mind, it is clear that there is a need for an improved golf board game which will closely simulate real golf and will help satisfy the strong appetite of golfers' golfing experiences and competition.

OBJECTS OF THE INVENTION

It is an object of this invention to provide an improved golf board game overcoming some of the problems and shortcomings of the prior art.

Another object of this invention is to provide a golf board game which satisfies the desire of golfers to experience golfing competition more often than is usually possible.

Another object of this invention is to provide a golf board game having substantial variability in the layout of golf course holes.

Another object of this invention is to provide a golf board game which allows variability in golf hole layout both in selecting hole length and in selecting its location to provide variety in the array of hazards along its length.

Another object of this invention is to provide a golf board game which is simple to play and simple to understand.

Another object of this invention is to provide a golf board game having substantial tactical considerations which simulate the tactical considerations of real golf.

Another object is to provide a golf board game having random determiners for both shot distance and shot direction yielding substantially bell-shaped probabilities simulating the probabilities for distance and direction of shots in real golf.

These and other important objects will be apparent from the descriptions of this invention which follow.

SUMMARY OF THE INVENTION

This invention is a board game which simulates golf more accurately and more thoroughly than prior golf board games. The invention overcomes certain problems and shortcomings of prior golf board games, including those mentioned above.

The game includes a board simulating a golf playing field. The board is used to establish holes one after another for play, as hereafter described. A number of pieces representing the contestants golf balls progress along each golf hole. Random determiners such as dice are used in a particular manner to indicate the distance and direction of shots. The contestants play in the manner and order required by the rules of golf.

More specifically, the board game of this invention includes a base board which has an annular lower map area mapping both fairway surface and a contiguous array of hazards, such as trees and bushes, water, sand traps, out-of-bounds, and the like. In primary embodiments of this invention, an overlay is rotatably attached to the base board and is above it. The overlay has at least one upper map area which maps golf course surface and covers some but not all of the lower map area. Adjacent (uncovered) portions of the lower map area remain exposed such that the upper map area and the exposed lower map area together form a variable annular golf course playing field.

Rotation of the overlay with respect to the base board varies the golf course playing field. A grid of substantially radial distance lines and substantially annular direction lines is on the map areas such that whatever combination of exposed lower map area and upper map area forms the annular golf course playing field, such playing field is marked with the grid.

The annular golf course playing field preferably has substantially circular inner and outer edges such that rotation of the overlay with respect to the base board does not change the shape of the annular playing field, but only changes the portion of the lower map area which is exposed.

The overlay preferably has one upper map area representing a putting green. Such upper map area may also include one or more sand traps on it near its edges and contiguous with the green. In preferred embodiments a multiplicity of holes are in the upper map area which represents the putting green in order to allow variable flag placement on the green.

Certain preferred embodiments have an upper map area which includes more fairway surface and a second contiguous array of hazards. Such upper map area and the adjacent exposed lower map area together form an annular length having a unique combination of fairway characteristics and hazards. Nearly infinite variety is possible in setting the tee-to-green characteristics of the golf holes. This is accomplished by appropriate variations in the relative rotational positions of the overlay and base board and by setting starting points and finishing points for a golf hole.

In the most preferred embodiments, there are at least two (and preferably only two) upper map areas formed by the overlay. These include one representing a putting green as described, and another representing fairway and array of hazards as described. Major void areas through which the lower map area is exposed are located between adjacent ends of such two upper map areas.

In highly preferred embodiments, a top member (board) is located over the annular golf course playing field and is rotatable with respect thereto about the axis of rotation of the overlay. The base board, overlay, and such top board preferably are all attached together by a single central connector defining the common rotation axis. The connector may be a small bolt and corresponding nut which is easily hand removable. The connection is made in a manner allowing unimpeded rotation of the overlay and the top board with respect to each other and the base board.

The top board is preferably shaped something like a keyhole, including a substantially circular center area and a tee area extending radially from such circular center area. The center point of the center area has a hole to accommodate the attachment member.

The tee area has at least one radial lead edge, and preferably a pair of radial lead edges on its opposite sides. Each lead edge provides a starting place locator for play, and ball markers which represent the golfers' balls can be placed on or against the lead edge for the beginning of play.

After shot-making (hereafter described) has begun and all players have taken their initial shots, the top board is rotated until its radial lead edge is against the shot marker which represents the ball farthest from the green. This is the ball of the player who, under the rules of golf, is required to shoot next, regardless of how many shots he may already have taken on the hole. Such rotation of the top member continues, always to the ball position of the player farthest from the green, until all balls have reached the green.

The circular center area has an outward edge which is aligned with the inner edge of the annular playing field. The outward edge has a shot measurement gauge along it beginning with zero at each radial lead edge, such gauge corresponding in scale with the radial distance lines on the map areas, referred to above.

Since the radial lead edge of the top member, which is at the zero point, is always aligned with the ball of the player on the fairway who is farthest from the green and who shoots next, the shot measurement gauge on the circular center area of the top member is in place to serve as a ready aid in finding the grid line corresponding to the length of the shot which is taken.

In certain preferred embodiments, the annular playing field has at least one hole length indication scale therealong which corresponds in scale with the radial distance lines on the map areas. It is preferred that the playing field have two such hole length indication scales along it, one running clockwise and the other running counter clockwise.

In the most preferred embodiments, the overlay will have one upper map area representing a putting green and two hole length indication scales each beginning at zero at the putting green but extending in opposite directions, one clockwise and the other counter-clockwise, in order to accommodate approaches to the putting green in either direction. Each of such hole length scales can extend for a full 360 degrees.

Such hole length indication scales are most preferably along an outside edge of the overlay. Thus, the overlay itself can be a generally circular board having an outside edge which has an annular strip running along an upper map area representing a putting green, then along a void area, then along an upper map area representing fairway and an array of hazards, and finally along another void area until such annular strip returns again to the putting green area. The shot length indication scales are on such annular strip.

In highly preferred embodiments, the base board has a perimeter marking with which selected points on the hole length indication scale(s) can be aligned in setting up golf holes to be played in the manner hereafter described. Such perimeter marking can be fixed on the base board or can itself be movable from time to time to further increase the degree of variability in the layout of golf holes to be played.

Whether such perimeter marking is moved or remains in a fixed location, it makes the establishment of a golf hole to be played a fairly easy matter. Once it has been decided what length the next hole to be played should be and whether the play will move in a clockwise or counter-clockwise direction, the overlay board will be rotated until the selected distance marking on the appropriate hole length indication scale is aligned with the perimeter marking. Then the top board is rotated such that the lead edge facing the direction of intended play is itself aligned with the perimeter marking. Playing such established hole is then set to begin.

Before describing the manner of play, the playing pieces used on the board will be described.

A ball marker is required for each player; ball markers of different colors may be used. Each marker should be sized so that it can readily and accurately be placed on a grid intersection to mark a ball position without causing doubt as to which grid intersection is intended. A flag or cup marker is also required and, before play begins on any hole, the flag is inserted in a chosen hole on the green. Score markers or some other device to maintain a running tally of the number of shots taken, including penalty strokes, are also required. These can be little discs which are moved along markers on the border of the base board. Any other kind of suitable scoring implement or means can be used.

Finally, two sets of limited random determiners, including a one set of distance determiners and another set of direction determiners are required. The random determiners of each set have a characteristic color, size, or other recognizable quality to distinguish them from those of the other set.

Each set of limited random determiners has a multiplicity of limited random determiners in order to provide substantially bell-shaped probability curves with respect to shot distance and shot direction. On all shots other putts, both sets of random determiners (or, in the case of the distance determiners, some subset) must be used, and this is preferably done by rolling all dice which are used at once (that is, in a single roll).

The two numbers generated by the two sets of dice or other random determiners determine a specific intersection on the grid. The ball marker of the player who generated the numbers is advanced to the intersection of the radial grid line which the distance determiners dictated with the annular line which the direction determiners dictated, as hereafter explained.

Since the grid covers all parts of the annular playing field, including fairway, hazards and green, a player's ball may land in any of these areas, with the likelihood of landing in any particular area being dependent on the distance to such area and certain choices, hereafter explained, with respect to distance.

In highly preferred embodiments, the distance determiners are a set of five dice all or some subset of which may be used in simulated shot making. Each dot represents ten yards and it can be seen that the distance achieved can be as little as ten yards in a case when one die is used and as much as 300 yards in the case when five dice are used. The number of dice in the subset of distance determiners has a relationship to club selection in golf. That is, large subsets will simulate the long irons or woods while small subsets will simulate the short irons.

Each set or subset of such distance determiners which is used generates a bell-shaped probability for the distance achieved by a shot. This is much the same as occurs in real golf. That is, with any given club a very short shot (for that club) can occur or a very long shot can occur. Typically, however, a middle length shot (for that club) is the most likely result.

The radial distance lines on the aforementioned grid are spaced by distances representing given lengths on the golf course, preferably ten yards. Thus, if a 12 is rolled, the ball marker of the player who "made" the shot is advanced 12 lines, which represents 120 yards.

A substantial tactical consideration is brought into the game by virtue of a game rule which allows the selection of any number of dice or other distance determiners, up to a preset limit (for example, five), in simulated shot making. By looking down the annular playing field at the green and at intervening hazards, a judgment can be made about how may dice should be used to reach the green, and the cup, considering the risks posed by hazards along the way.

Another tactical consideration relates to how many shots a player has already taken compared to the number a competitor has already taken. That is, given the status of a competitor's play, including even the hazards experienced or faced by him, greater or lesser risks may be assumed in a manner consistent with the overall objective of the player selecting a number of distance dice, that is, making a "club" or "shot" selection.

The hazards, whether they be water, sand traps, rough, out-of bounds, or trees and shrubs, all carry various risks. Penalties or limitations are imposed when a ball lands in them. For some, such as water hazards, penalty strokes are applied, while for most, such as sand traps, a limitation is imposed on the number of dice (or other determiners) which may be used in making a shot from them. For example, if a ball lands in a fairway sand trap, the player may be restricted to no more than three dice on his next shot, even though his ball may still be a long way from the green. This kind of possibility and limitation adds to game tactical considerations.

In preferred embodiments, the direction determiners are a set of at least two, and preferably just two, dice, all (both) of which must be used in simulated shot making. Using two dice, for example, the resulting direction numbers can be as few as two and as many as 12. Thus, when two dice are direction determiners, the grid will include 11 substantially annular direction lines labeled 2 through 12, respectively.

The middle numbers, that is, 5, 6, 7, 8 and 9, are the numbers on the annular grid lines toward the middle of the width of the grid path. Thus, middle numbers tend to represent more or less straight shooting of golf shots.

The probability of shooting in a particular serious wrong direction is small, but not insignificant. The probability of some shots which are off-direction in one way or another is fairly high. This is not unlike real golf in which, although players cannot control their shot direction perfectly, their shots are more likely to be somewhere the center of a fairway than at a particular wide direction.

With most parts of the annular playing field, the probability of landing in a hazard goes up as the ball direction strays from the middle course. The placement and width of hazards must be taken into account when the number of distance determiners is selected for a shot; wide hazards extending in the middle of the annular playing field imposed substantial risk, adding tactical considerations to the game.

As already discussed, tactical considerations come into play in a number of ways in the golf board game of this invention. Depending upon the playing field characteristics which loom ahead, such as the width of the fairway, the placement, size and nearness of various hazards, the nearness of the green, and the number of shots a player and his opponents have already taken, the choice of the number of dice or other distance determiners to use can be a most interesting one. High risk may often mean substantial rewards if the risk-taking is successful, or a substantial loss if unsuccessful. During play, the tactical considerations create the same sort of intellectual excitement and interest that real golf creates.

A unique characteristic of the simulated golf game of this invention is that holes can be set up to duplicate any golf course in the world. That is, those playing the game can take a score card from their favorite golf course or from some well known remote golf course, and set up the holes sequentially for the appropriate distances. If desired, variations in hole set up can be made to place greater or lesser hazard risks on the hole. This can be accomplished if desired, simply by relocation of the perimeter marking on the base board.

Also, if desired, changes can be made in the surface characteristics of the map areas by applying various removable surfaces having different hazard and fairway characteristics. However, this latter variation is hardly necessary for sufficient variation or excitement, given the infinite variety of golf hole characteristics which are possible through rotational adjustment of the parts of this invention, as described.

A simple set of rules is established for playing the golf board game of this invention. The rules are the same rules as are used for real golf, with only minor variations. A specific set of rules is also established for putting on the putting green.

It is preferred that the grid on the putting green have twice as many radially directed lines as there are on other areas of the playing field. The annular lines on the green, however, are continuations of the annular lines on the remainder of the playing field.

One set of putting rules found to be satisfactory is as follows:

Direction determiners are not used during putting; only the distance determining dice or other distance determiners are used. Any number of distance determiners may be used, for example, from one to five dice. The number determined by the rolling of such dice is then applied to move a player's ball on the green by counting along from point to point on the grid.

In utilizing such number, it must first be determined whether the ball is resting on a grid line that intersects the cup. If it is, a player's ball marker may proceed directly toward the cup or may instead move to the right or to the left to use up some points and then turn in the direction of the cup. After such a turn, when a line intersecting the cup is reached, the ball marker must turn toward the cup and use up the remaining points without deviating from such line. Such movement along a bisecting line may be short or may be long, or, if the number was right and the player did his counting properly, the ball may be in the cup. When the ball comes to rest at a grid point immediately adjacent to a hole, one additional stroke is simply added.

When putting starts from a grid position which is on a line that does not intersect the cup, a player's ball must proceed toward the cup. In so proceeding, a line that intersects the hole can be passed, but only once. The second time that a line which intersects the hole is reached, the player must turn toward the cup and continue toward the cup until all points are used up, as described above.

Depending upon the design of the green, more specifically, its size and the extent to which traps interrupt its edges, the number of puts required will typically be one, two or three, and only in rare cases more. This closely simulates real putting in golf.

A simplified version of the golf board game of this invention utilizes a base board having an annular golf course playing field which maps fairway surface and a contiguous array of hazards. Such annular playing field has substantially inner and outer edges. The board games includes a green on the annular golf course playing field and has a grid of substantially radial distance lines and substantially annular direction lines over the entire annular playing field. In preferred embodiments of such simplified version, a top member of the type described above is utilized, and a hole length indication scale of the type described above is used as well.

Using this simplified version limits the degree of variability of golf hole characteristics. However, by changing hole lengths and approach directions, substantial variations in play and changes in tactical considerations are present.

NUMBERED DESCRIPTION OF PREFERRED EMBODIMENT

Figure 1:
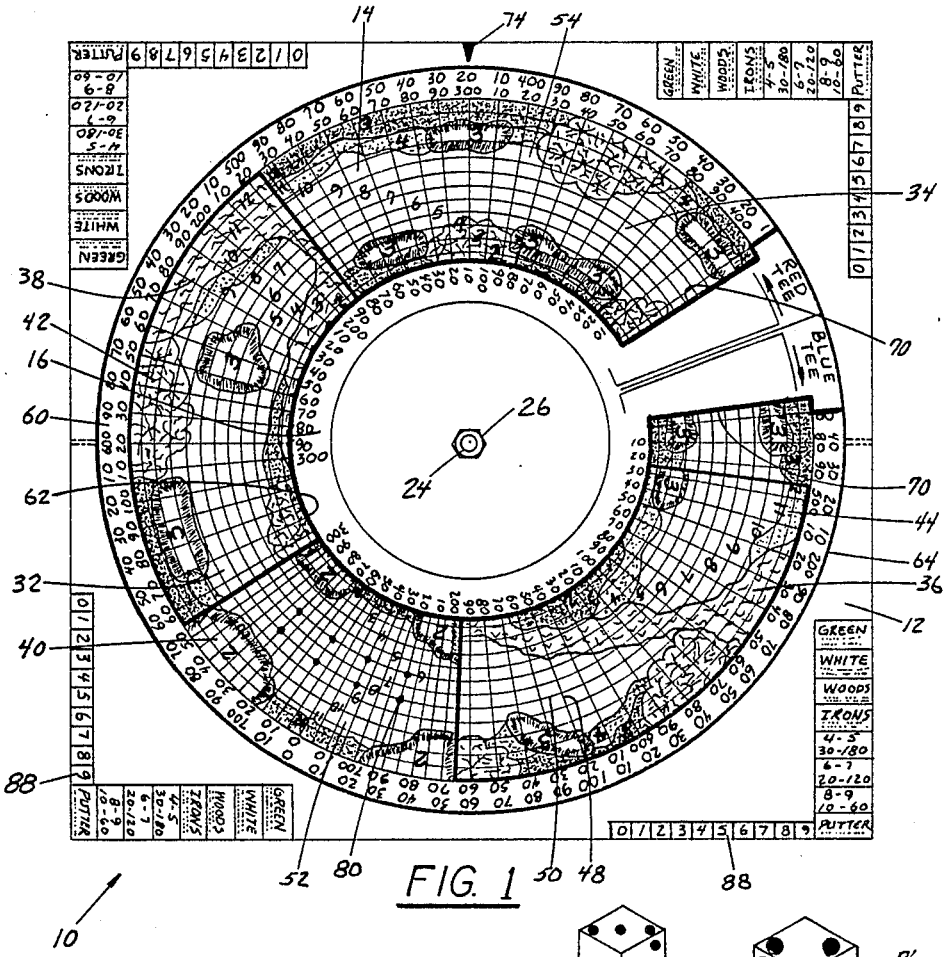
FIG. 1 is a top plan view of the golf board game of this invention.

The figures illustrate a golf board game 10 in accordance with this invention. Golf board game 10 includes three boards which together form a playing board. These include a base board 12, an overlay board 14, and a top board 16. Boards 12, 14 and 16 have small central holes 18, 20 and 22, respectively, through which a threaded connector 24, secured by a nut 26, extends to hold the boards in overlying rotational relationship.

Boards 12, 14 and 16 are preferably made of heavy, relatively stiff paperboard or other planar materials. The physical quality of the game is improved with relatively thick, non-bendable board materials; however, a variety of planar members may be used.

Base board 12 and overlay board 14 have fold liner 28 and 30, respectively, which allow each of them to be doubled over onto themselves easily for storage in a box slightly bigger than half the size of base board 12. Top board 16 is dimensioned such that for storage it can overlie half of base board 12.

Figure 4:
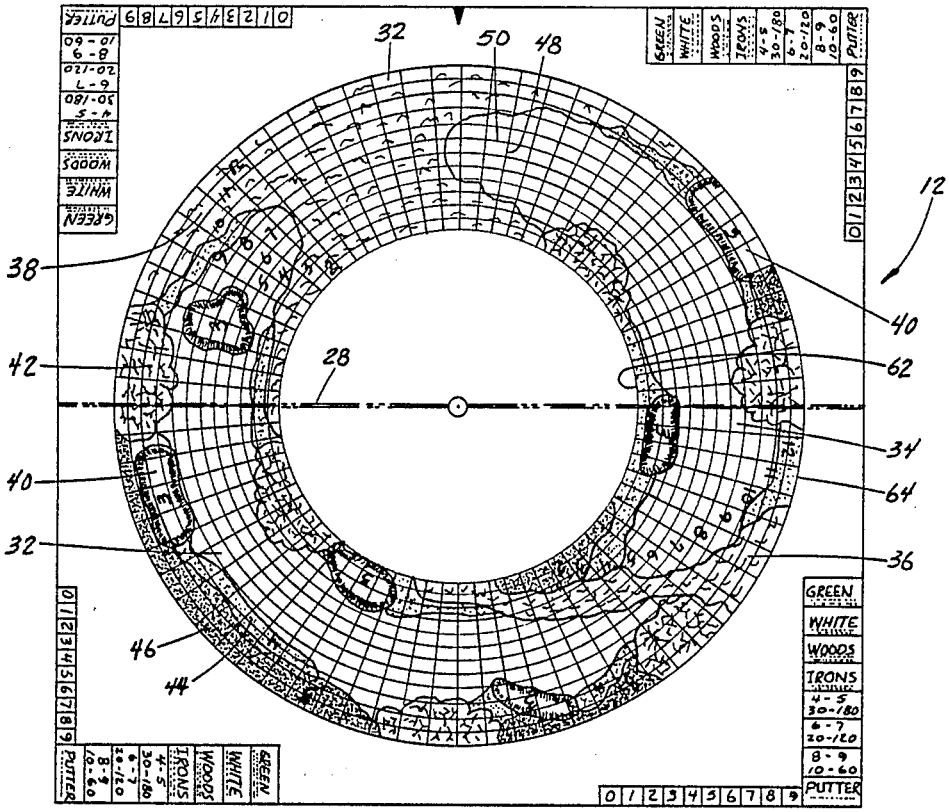

Base board 12, illustrated best in FIG. 4, is a square board having an annular lower map area 32 printed or otherwise applied to it on its top surface. Lower map area 32 maps fairway surface 34 and a contiguous array of hazards, including a water hazard 36 representing a stream extending across fairway 34, a water hazard 38 representing a lake or pond extending across fairway 34, a number of sand traps 40, tree/bush areas 42, rough areas 44, and out-of-bounds areas 46.

A grid consisting of equally spaced radial lines 48 and equally spaced annular lines 50 is printed over all of annular lower map area 32. Each adjacent pair of radial grid lines 48 represents ten yards along the length of any golf hole. Each annular grid line 50 represents a lateral position across any golf hole. One or more portions of annular lower map area 32, either alone or in combination with a portion of a similar map on overlay board 14, will form the major length of a golf hole, that is, the portion between the tee and the green.

Figure 5:
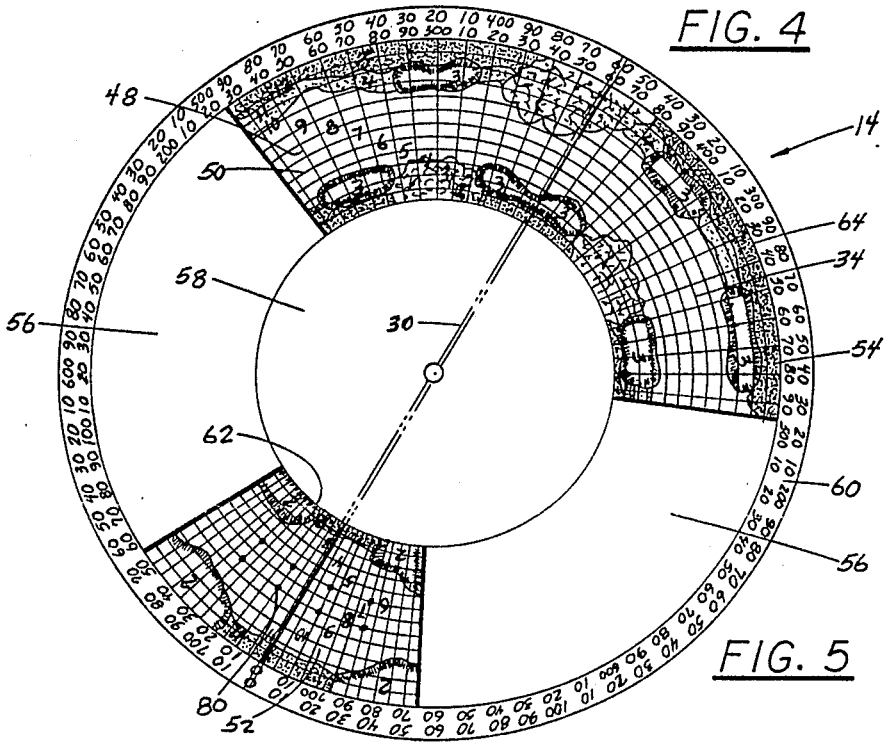

Overlay board 14, as shown in FIG. 5, is a round board which, as previously noted, is rotatable with respect to base board 12. It has two upper map areas, including a first upper map area or putting green area 52 and a second upper map area 54. Second upper map area 54 includes more fairway surface 34 and a second contiguous array of hazards generally similar to the hazards already described, although placed in completely different arrangements with respect to fairway surface 34.

Between adjacent edges of first and second upper map areas 52 and 54 are a pair of voids or openings 56 in overlay board 14. Voids 56 are bordered on their radially inner edges by the outer edge of a circular center portion 58 of overlay board 14 and on their radially outer edges by an annular outside edge strip 60 which is also part of overlay board 14.

Outside edge strip 60 has a pair of hole length indication scales completely therearound, each beginning at zero at a radial location corresponding to the center point of putting green area 52. The hole length indication scales correspond in scale with radial grid lines 48 and thus can be used to measure distances along a golf hole. One of such hole length indication scales is clockwise and the other is counter-clockwise; this accommodates the measuring of the lengths of holes approaching putting green area 52 from either direction.

Upper map areas 52 and 54 cover the portions of lower map area 32 which are beneath them; however, voids 56 expose adjacent portions of lower map area 32 such that, by virtue of the relative rotational positioning of overlay board 14 and base board 12, upper map portions 52 and 54 and the exposed lower map portions form a variable annular golf course playing field, shown in FIG. 1.

The annular golf course playing field has a circular inner edge 62 and a circular outer edge 64, such that relative rotation of boards 12 and 14 do not change the shape of the annular golf course playing field, but change only the combination of playing field characteristics.

Figure 6:
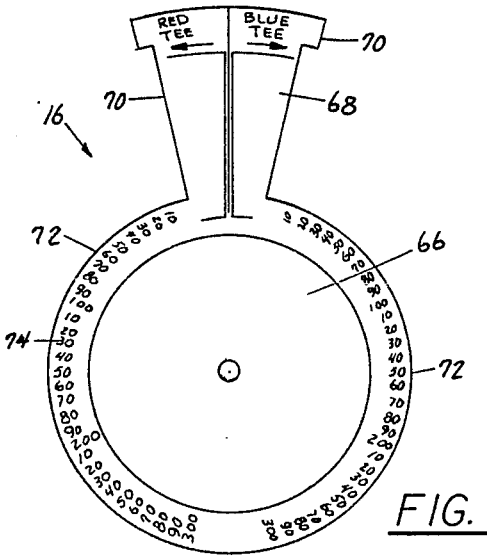
FIGS. 4–6 are plan views of the base board, the overlay board, and the top board, respectively, without surface printing.

Top board 16, as illustrated in FIGS. 1 and 6, is located above overlay board 14 and is rotatable with respect thereto. Top board 16 includes a circular center area 66 and a narrow radially extending tee area 68. Tee area 68 is divided into two equal portions, a red tee and a blue tee as marked, each having a radial lead edge 70 extending across the annular golf course playing field.

Circular center area 66 of top board 16 has an outward edge 72 having a diameter equal to the diameter of inner edge 62 of the annular golf course playing field such that outward edge 72 is in alignment with inner edge 62. Along outward edge 72, extending in opposite directions from positions near radial lead edges 70, are a pair of shot-measurement gauges which measure from zero from 300. Such measurements refer to yards and the shot-measurement gauges correspond in scale with radial grid lines 48.

Top board 16 is used as a measurement gauge for each player's shots in the manner previously described. During play it is moved from the starting position for a golf hole, which has been established, to more forward positions in each case representing the position of the ball farthest from the green. Thus, on each shot the measurement gauge is advanced, until all player's ball markers are on the green.

Base board 12 has a perimeter marking 74 on it which is an arrow. Perimeter marking 74 is used by aligning with it a selected point on one of the two hole length indication scales along annular edge strip 60 of overlay board 14. For example, if play in a clockwise direction is intended and the length of the intended hole is 420 yards, overlay board 14 is rotated until the outer hole length indication scale along annular edge strip 60 is aligned with perimeter marking 74. FIG. 1 illustrates this rotational position of overlay board 14.

Before play on such hole begins, top board 16 is rotated such that its lead edge 70 is beside the radial grid line which is aligned with perimeter marking 74. Actually, lead edges 70 are notched to accommodate placement of ball markers directly on radial grid lines, as illustrated in FIGS. 1 and 6. In FIG. 1, top board 16 has already been rotated away from the 420 yard starting position in a clockwise direction until it is in a position of alignment with the ball in play farthest from putting green area 52. As play progresses, top board 16 is moved clockwise each time to the ball then farthest from putting green area 52.

Perimeter marking 74 can be moved to a different position on base board 12. By relocating perimeter marking 74 the already very substantial golf hole variability achievable is greatly increased.

Figure 2:
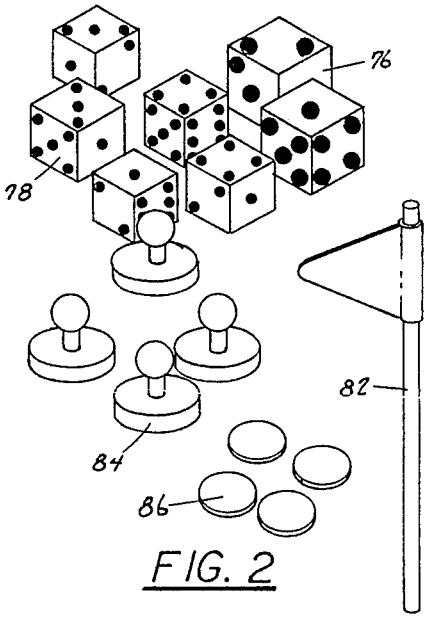
FIG. 2 is a perspective view of certain playing pieces used in the game of this invention.
Figure 3:
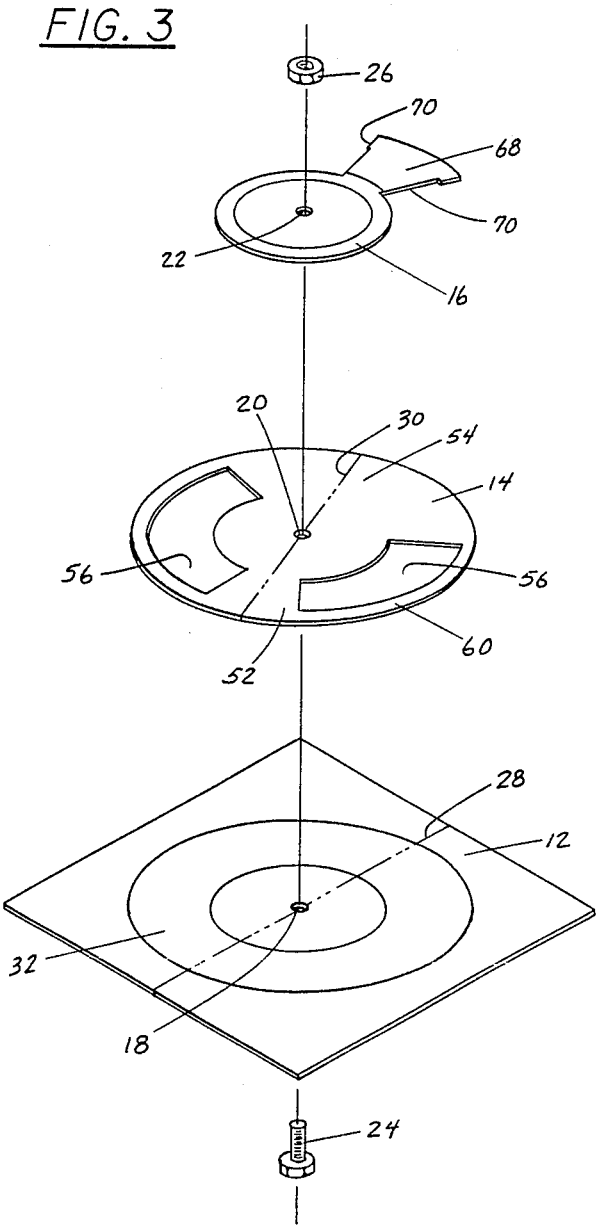
FIG. 3 is an exploded perspective view of the board assembly shown in FIG. 1.

As illustrated in FIG. 2, there are two different sets of dice, including the large dice 72 which form a set of random direction determiners and the small dice 78 which form a set of random distance determiners. Such dice are rolled together, either from a players's hand or out of a dice container, perferably onto circular center area 66.

As previously described, on all shots other than putting strokes, both large dice 76 are used and all or a subset of small dice 78 are used. The combined total of the number of dots on the two large dice determines on which annular grid line 50 a ball will land, and the total of the number of dots on the thrown small dice 78 will determine on which radial grid line 48 a ball will land.

After the sets of dice have been rolled to "make" a shot, the intersection of one radial grid line and one annular grid line determine the location of the ball and thus the position from which the next shot will be taken. Annular grid lines 50 are identified by numerals shown at various places on the annular playing field.

The intersection at which a ball lands may be in fairway 34, in one of the hazards 36, 38, 40, 42, 44 or 46, or on the putting green. If the ball lands in certain hazards, the maximum number of small dice which can be used to determine the distance of the next shot is specified by a numeral printed in such hazard area. For example, a shot taken from a sand trap can be determined with no more than three small dice 78, which of course restricts the possible distance of the shot. Other hazards such as water impose shot penalties, as in real golf.

First upper map area, which includes the putting green, itself has sand traps 40 about its edges. The sand traps on first upper map area 52 limit the number of small dice which can be used in determining the shot distance, but putting rules are applied.

Putting green area 52 has a number of cup-locating holes or openings 80 on it. As play is begun on any golf hole, the flag illustrated in FIG. 2 is placed in one of the openings 80, and this establishes the precise target for that golf hole. The placement of flag 82 has a substantial effect on game tactics as the players approach the green. Club selection, that is, the selection of how many small dice to use, is often affected by such flag placement and by the nearness of hazards of any kind.

Also illustrated in FIG. 2 are four ball markers 84. Ball markers 84 are sized to be placed on the intersection of a specific radial grid line 48 with a specific annular grid line 50. Also shown in FIG. 2 are a number of scoring markers 86 which may be used to keep shot scores for each player on any given hole. Scoring markers 86 are placed on and moved along scoring strips 88 located near each of the four corners of base board 12.

Also located along each of the corners of base board 12 is a series of shot selection guides which correlate various golf clubs to the lengths of shots they can provide and the number of dice ideally selected, quite apart, of course, from the tactical considerations imposed by hazards looming ahead, by the scores of competitors, by pin placement concerns, and the like. These serve merely as a guide, and have no part in the rules of the game. Individual players must make their own judgments in preparing for their shots.

A great many variations can be made in the game apparatus shown and in the game rules applied. For example, different types of limited random determiners and sets of limited random determiners can be used. A different number of annular direction lines can be used. The annular direction lines need not be concentric circles; indeed, they need not be continuous.

Simpler versions and more complex versions of the game can be developed. The basic principles of play and layout can be applied to other games and situations having similarities to golf. And, the basic principles or course variation can be applied to course or field shapes differing somewhat from those shown.

While the principles of this invention have been described in connection with specific embodiments, it should be understood clearly that these descriptions are made only by way of example and are not intended to limit the scope of the invention.

What is claimed is:

1. A board game simulating golf comprising:

a base board having an annular lower map area bearing indicia designating fairway surface and a contiguous first array of hazards;

an overlay rotatable with respect to the base board and having:

at least one upper map area which covers and visually hides some of the lower map area and bears indicia designating golf course surface; and at least one void area adjacent to the at least one upper map area such that portions of the lower map area which are adjacent to the covered portions of the lower map area are visually exposed, whereby the at least one upper map area and at least one exposed lower map area are rotationally-offset and form a variable annularly-extending golf course playing field; and a grid of substantially radial distance lines and annular direction lines on the map areas.

2. The board game of claim 1 wherein the annular golf course playing field has substantially circular inner and outer edges.

3. The board game of claim 2 wherein the at least one upper map area includes one map area bearing indicia designating a putting green, the putting green having a multiplicity of cup placement sites thereon.

4. The board game of claim 2 wherein the overlay includes at least one hole length indication scale extending peripherally therearound along the edge of the playing field, such scale corresponding with the radial distance lines on the map areas.

5. The board game of claim 1 further including two sets of limited random determiners, including a set of distance determiners and a set of direction determiners, each set having a multiplicity of limited random determiners in order to provide substantially bell-shaped probability curves with respect to shot distance and shot direction.

6. The board game of claim 5 wherein:

the distance determiners are a set of five dice some subset of which may be used in simulated shot-making; and the direction determiners are a set of at least two dice all of which must be used in simulated shot-making.

7. A board game simulating golf comprising:

a base board having an annular lower map area bearing indicia designating fairway surface and a contiguous first array of hazards;

an overlay rotatable with respect to the base board and having at least one upper map area bearing indicia designating golf course surface and covering some of the lower map area, adjacent portions thereof being exposed such that the upper map area and exposed lower map area form a variable annular golf course playing field, said annular playing field having substantially circular inner and outer edges;

said upper map area including one map area bearing indicia designating more fairway surface and a second contiguous array of hazards; and a grid of substantially radial distance lines and annular direction lines on the map areas.

8. The board game of claim 7 wherein the at least one upper map area comprises a map area bearing indicia designating a putting green.

9. A board game simulating golf comprising:

a base board having an annular lower map area bearing indicia designating fairway surface and a contiguous first array of hazards;

an overlay rotatable with respect to the base board and having at least one upper map area bearing indicia designating golf course surface and covering some of the lower map area, adjacent portions thereof being exposed such that the upper map area and exposed lower map area form a variable annular golf course playing field, said annular playing field having substantially circular inner and outer edges;

a grid of substantially radial distance lines and annular direction lines on the map areas; and a top member located over the annular golf course playing field and rotatable with respect thereto about a common axis with the overlay, said to member including a tee area having at least one radial lead edge.

10. The board game of claim 9 wherein the top member further includes a substantially circular center area having an outward edge aligned with the inner edge of the annular playing field, said outward edge having a shot measurement gauge therealong beginning at the lead edge and corresponding in scale with the radial distance lines on the map areas.

11. A board game simulating golf comprising:

a base board having an annular lower map area bearing indicia designating fairway surface and a contiguous first array of hazards;

an overlay rotatable with respect to the base board and having at least one upper map area bearing indicia designating golf course surface and covering some of the lower map area, adjacent portions thereof being exposed such that the upper area and exposed lower map area form a variable annular golf course playing field, said annular playing field having substantially circular inner and outer edges;

a grid of substantially radial distance lines and annular direction lines on the map areas;

the at least one upper map area including one map area bearing indicia designating a putting green; and the overlay having an outside edge strip having clockwise and counterclockwise hole length indication scales thereon extending peripherally therearound along the edge of the playing field, said scales corresponding with the radial distance lines on the map areas and each beginning at zero at said putting green to accommodate approaches to the putting green in either direction.

12. The board game of claim 11 wherein the base board has a perimeter marking with which selected points on the hole length indication scale can be aligned in setting up golf holes to be played.

13. The board game of claim 11 further icluding a top member over the annular golf course playing field and rotatable with respect thereto about a common axis with the overlay, said top member including a tee area having two radial lead edges such that the tee area can be used for play in either a clockwise or a counterclockwise direction.

14. The board game of claim 13 wherein the top member further includes a substantially circular center area having an outward edge aligned with the inner edge of the annular playing field, said outward edge having shot measurement gauges therealong beginning at the lead edges.

15. A board game simulating golf comprising:

a base board having an annular golf course playing field bearing indicia designating fairway surface and a contigous array of hazards, said annular playing field having substantially circular inner and outer edges;

a green on the annular golf course playing field i a top member over the annular golf course playing field designating a tee area in rotationally-offset position with respect to the green;

the top member including a radial lead edge and a substantially circular center area having an outward edge aligned with the inner edge of the annular playing field, said outward edge having a shot measurement gauge therealong beginning at the lead edge and corresponding in scale with the radial distance lines on the map areas;

a grid of substantially radial distance lines and substantially annular direction lines on the annular playing field; and two sets of limited random determiners, including a set of distance determiners and a set of direction determiners, each set having a multiplicity of limited random determiners in order to provide substantially bell-shaped probability curves with respect to shot distance and shot direction, the limited random determiners of each set having a common visual characteristic which visually distinguishes each of them from the limited random determiners of the other set.

16. A board game simulating golf comprising:

a base board having an annular golf course playing field bearing indicia designating fairway surface and a contiguous array of hazards, said annular playing field having substantially circular inner and outer edges;

a green on the annular golf course playing field;

a grid of substantially radial distance lines and annular direction lines on the annular playing fields and a top member over the annular golf course playing field and rotatable with respect thereto, said top member including a tee area having a radial lead edge and a substantially circular center area having an outward edge aligned with the inner edge of the annular playing field, the outward edge having a shot measurement gauge therealong beginning at the lead edge and corresponding in scale with the radial distance lines on the map areas.

17. The board game of claim 16 wherein a hole length indication scale which corresponds in scale with the radial distance lines on the map areas is along the outer edge of the annular playing field.

18. A board game comprising:

a base board having an annular lower map area bearing indicia designating topographic course surface and a contiguous first array of separate topographical features;

an overlay rotatable with respect to the base board and having:

at least one upper map area which covers and visually hides some of the lower map area and bears indicia designating topographic course surface; and at least one void area adjacent to the at least one upper map area such that portions of the lower map area which are adjacent to the covered portions of the lower map area are visually exposed, whereby the at least one upper map area and at least one exposed lower map area are rotationally-offset and form a variable annularly-extending topographical playing course; and a grid of substantially radial distance lines and annular direction lines on the map areas.

19. The board game of claim 18 wherein:

the lower map area is annular;

the overlay is rotatable with respect to the base board such that the variable field of play formed by the lower and upper map areas is annular; and the distance lines are substantially radial in orientation and the direction lines are substantially annular.

* * * * *

UNITED STATES PATENT AND TRADEMARK OFFICE

CERTIFICATE OF CORRECTION

PATENT NO. : 4,759,548

DATED : July 26, 1988

INVENTOR(S) : Joseph M. Chaban

It is certified that error appears in the above-identified patent and that said Letters Patent is hereby corrected as shown below:

In column 3, line 4, change "contestants" to --contestants'--.

In column 5, line 40, after "other" insert --than--.

In column 8, line 58, change "liner" to --lines--.

In column 12, line 25, after "dice" insert --at least--.

In column 12, line 68, change "to" to --top--.

In column 13, line 18, after "upper" insert --map--.

In column 13, line 57, change "contigous" to --contiguous--.

In column 13, line 60, change "field i" to --field;--.

In column 14, line 24, change "fields" to --field;--.

Signed and Sealed this

Twenty-ninth Day of November, 1988

*Attest:*

*Attesting Officer*

DONALD J. QUIGG

*Commissioner of Patents and Trademarks*